US005429754A

United States Patent [19]

Lin et al.

[11] Patent Number: 5,429,754

[45] Date of Patent: Jul. 4, 1995

[54] FABRIC CONDITIONING COMPOSITION ASSOCIATED WATER SOLUBLE POLYMERS

[75] Inventors: Samuel Q. Lin, Paramus; Liang S. Tsaur, Norwood; Lucia V. Salas, North Bergen, all of N.J.

[73] Assignee: Lever Brothers Company, Division of Conopco, Inc., New York, N.Y.

[21] Appl. No.: 237,496

[22] Filed: May 3, 1994

[51] Int. Cl.[6] ..... D06M 13/248; D06M 13/46

[52] U.S. Cl. ..... 252/8.6; 252/8.7; 252/8.75; 252/8.8; 252/8.9

[58] Field of Search ..... 252/8.6, 8.7, 8.75, 252/8.8, 8.9

[56] References Cited

U.S. PATENT DOCUMENTS 4,386,000 5/1983 Turner et al. ..... 252/8.8
4,661,270 4/1987 Grandmaire et al. ..... 252/8.75
5,147,576 9/1992 Montague et al. ..... 252/174.23

FOREIGN PATENT DOCUMENTS 13780 8/1980 European Pat. Off. .

*Primary Examiner*—Mark L. Bell
*Assistant Examiner*—C. M. Bonner
*Attorney, Agent, or Firm*—A. Kate Huffman

[57] ABSTRACT

A fabric conditioning composition comprising a water soluble polymer having a hydrophilic backbone associated with an acidic group used to improve formulation and stability of such compositions.

6 Claims, No Drawings

FABRIC CONDITIONING COMPOSITION ASSOCIATED WATER SOLUBLE POLYMERS

FIELD OF THE INVENTION

This invention relates to polymers with associated moieties for use in concentrated liquid fabric conditioning formulations.

BACKGROUND OF THE INVENTION

In the climate of environmentally friendly products, fabric conditioning formulations which are concentrated are more desirable. Liquid compositions are dispersions of lamellar droplets of fabric softening actives. When the concentration of such actives such as DHTDMAC goes above 10% per active base, the resulting products become highly viscous, unpourable and unstable due primarily to the flocculation of the lamellar droplets.

The prior art has addressed these problems, in part, by using decoupling polymers. Decoupling polymers are polymers formed from hydrophilic backbones with covalently bonded pendant hydrophobic side groups. These types of polymers are difficult and expensive to manufacture.

The covalently bound polymers are believed to deflocculate lamellar droplets because the hydrophobic roots of the polymers incorporate into an outer bilayer of the lamellar droplets. Thus, the polymers dangle from the droplet surface into a continuous aqueous phase of the fabric conditioning formulation to reduce the attractive interaction forces between droplets and prevent the droplets from flocculating. Product stability thus results from the decrease in flocculation and viscosity.

SUMMARY OF THE INVENTION

It is an object of the present invention to provide water soluble polymers having hydrophilic backbones with acidic groups to provide stable concentrated fabric conditioning compositions.

A further object of the invention is to provide novel polymers and processes of forming them which are more cost effective and efficient.

The polymers of the present invention are predominantly linear water soluble polymers having solubilities in water of greater than 1 gram per liter. Hydrophilic backbones of the polymers are associated with acidic side groups ranging from about 0.1% to 30% by repeat unit. The average molecular weight of the; novel polymers as measured by gel permeation chromatography (GPC) ranges from 1,000 to 50,000.

The hydrophilic monomer units of the backbone are linked together by groups such as ether, ester, ethylene and amide. The hydrophilic monomer units include ethylenically unsaturated amides, esters of ethylenically unsaturated acrylic and methacrylic acids, vinyl alcohol obtained by hydrolysis of vinyl acetate, ethylene oxide, ethylene amide, and sugars from which polysaccharides such as starch and cellulose polymers are derived.

The acidic side groups which are associated with the hydrophilic backbones are introduced into the polymers either from acidic comonomers, acidic chain transfer agents, or by a reaction product of a chemical modification of the polymers. Useful acidic comonomers include acrylic acid, methacrylic acid, maleic anhydride, and vinyl sulfonic acid. Acidic chain transfer agents useful in the invention include mercaptosuccinic acid and mercaptoacetic acid.

The fabric conditioning compositions of the invention comprise an effective fabric softening active in an amount of from 10 to 80 wt. %, 0.01% to 5% by weight of the polymers and 0.01 to 5% by weight of an electrolyte.

DETAILED DESCRIPTION OF PREFERRED EMBODIMENTS

The polymers of the present invention are predominately linear water soluble polymers having solubilities greater than 1 gram per liter, preferably greater than 5 grams per liter and most preferably greater than 10 grams per liter.

The water solubility of a polymer is determined by its hydrophilic backbone. The backbone should be made of hydrophilic monomer units which are linked together by groups such as ether, ester, ethylene or amide.

Hydrophilic monomer units useful in the invention include:

(1) ethylenically unsaturated amides such as acrylamide, methacrylimade and fumaramide;
(2) esters of ethylenically unsaturated acrylic and methacrylic acids such as hydroxyethyl acrylate, hydroxylethyl methacrylate;
(3) vinyl heteroacrylic amides such as vinyl pyrrolidone;
(4) vinyl alcohol obtained by the hydrolysis of vinyl acetate;
(5) ethylene oxide;
(6) ethylene imine; and
(7) sugars from which starch and cellulose polysaccharides are derived.

Suitable non-limiting commercially available examples of the hydrophilic monomer units include: acrylamide, methacrylamide, hydroxyethylacrylate, hydroxypropylacrylate, N,N-dimethylacrylamide, and polyethyleneglycol acrylates. Hydroxyethylacrylate and acrylamide are preferred.

Acidic groups are introduced to the hydrophilic monomer units either from acidic comonomers, acidic chain transfer agents, or by chemical modification of the hydrophilic monomer units. The acidic groups range from about 0.1% to 30% by repeat unit, preferably from about 1% to 20% and most preferably from about 2% to 10%.

Examples of the acidic comonomers include acrylic acid, methacrylic acid, maleic anhydride, vinyl sulfonic acid, and 2-acrylamido-2-methylpropane sulfonic acid. Examples of the acidic chain transfer agents include mercaptoacetic acid and mercaptosuccinic acid. The acidic groups are copolymerized to the backbone of monomer units either in their acidic form or in a neutralized salt form with a base such as .sodium hydroxide.

Examples of the acidic chain transfer agents include mercaptosuccinic acid, mercaptoacetic acid and mercaptopropanol.

Chemical modification of the polymer may occur by reacting hydroxyl containing polymers such as starch, cellulose and polyvinyl alcohol with chloroacidic acid. Modification may also occur by the oxidation of the hydroxyl containing polymers. Finally, modification of the polymers may occur by sulfonation of the hydrophilic monomer units containing unsaturated carbon-carbon bonds.

Suitable polymers within the scope of the invention include the following:

POLYMER A

Polymer A having a formula:

$$R_1-(HM)_x-(AM)_y-R_2 \quad (I)$$

wherein $R_1$ represents hydrogen or fragments of chemical modifying initiators selected from the group of hydroxyl, t-Butyl, and alkoxyl; $R_2$ represents hydrogen or fragments of acidic chain transfer agents such as mercaptopropanol.

HM represents a hydrophilic monomer including acrylamide, hydroxylethylacrylate, vinyl alcohol and etc. AM represents an acidic comonomer including acrylic acid, methacrylic acid, malic anhydride, and vinylsulfonic acid. Polymer A compounds are random copolymers, i.e., HM and AM are randomly linked together in the polymer backbone.

The ratio of x to y is 80:20 to 99:1, preferably 6–9:30 and x+y is 10 to 50.

Examples of Polymer A compounds suitable for the invention include:

a) A random copolymer of hydroxylethylacrylate and acrylic acid with a mercaptopropanol chain transfer agent of formula:

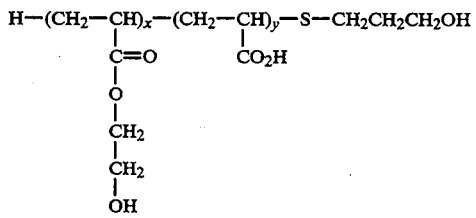

(II)

wherein x is 7 and Y is 3; and b) A random copolymer of an acrylamide and acrylic acid with a mercaptopropanol chain transfer agent having a formula:

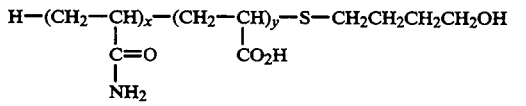

(III)

wherein x is 15 and Y is 3.

The copolymers of Formula II and III are prepared by free radical copolymerization of hydrophilic and acidic monomers.

POLYMER B

Polymer B compounds have a formula $$R_1-(HM)_x-AC \quad (IV)$$

wherein $R_1$ and HM are as defined above and x is 10 to 50. AC represents an acidic chain transfer agent including mercaptosuccinic acid and mercaptoacetic acid.

Polymer B is a polymer having acidic units located at the end of each polymer. Examples of polymer B suitable for the invention include:

a)

-continued

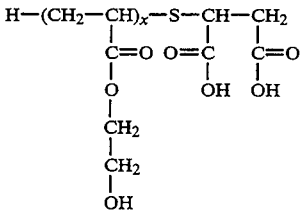

(V)

and b)

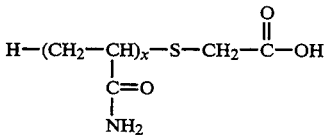

(VI)

wherein x is 10 to 50.

POLYMER C

Polymer C compounds have a formula:

$$R_1-(HM)_x-(AM)_y-AC \quad (VII)$$

The ratio of x to y is 80:20 to 99:1, preferably 6–9:30 and x+y is 10 to 50.

wherein $R_1$, HM, AM, AC and x are as defined above. Polymer C is a compound having a terminal acid per molecule in addition to the randomly distributed acids from the acidic monomers.

Examples of Polymer C suitable for the invention include:

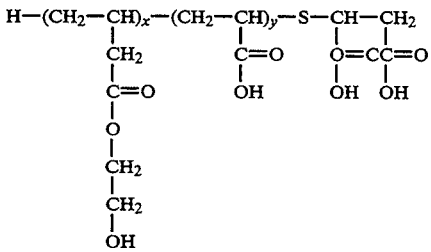

(VIII)

wherein x is 7 and y is 3.

The compositions according to the invention may contain one or a mixture of the three polymer types A, B and C described above.

The polymers generally contain a spectrum of structures and molecular weights. Thus, any structure of polymers described in the specification refers to polymers which are believed to be effective, however, preferably the polymers constitute a part of a polymer sample, provided that the amount of polymer in total is sufficient to effect the desired deflocculation effects.

The preferred molecular weights for the polymers of formulas I, IV and VII and their salts average from 500 to 50,000, preferably from 1,000 to 20,000 when measured by GPC using polyacrylic standards as known in the art. For the purposes of this definition, the GPC definition of the molecular weights of the standards are measured by the absolute intrinsic viscosity method described by Noda, Tsoge and Nagasawa in *Journal of Physical Chemistry*, Volume 74 (1970) pages, 710–719.

The polymer used in the compositions of the invention is in an amount of about 0.01% to 5% by weight, preferably 0.1 to 3%.

Fabric Conditioning Component

The fabric conditioning active used in the compositions of the invention is present in an amount ranging from 1% to 80% by weight, preferably from 10% to 70% and most preferably from 10 to 45%.

Hydrocarbon fabric softeners-suitable for use herein are selected from the following classes of compounds:

(i) Cationic quaternary ammonium salts. The counterion is methyl sulfate or any alkyl sulfate or any halide, methyl sulfate being preferred for the dryer-added articles of the invention.

Examples of cationic quaternary ammonium salts include, but are not limited to:

(1) Acyclic quaternary ammonium salts having at least two $C_{8-30}$, preferably $C_{12-22}$ alkyl chains, such as: ditallowdimethyl ammonium methylsulfate, di(hydrogenated tallow)dimethyl ammonium methylsulfate, distearyldimethyl ammonium methylsulfate, dicocodimethyl ammonium methylsulfate and the like;

(2) Cyclic quaternary ammonium salts of the imidazolinium type such as di(hydrogenated-tallow)dimethyl imidazolinium methylsulfate, 1-ethylene-bis(2-tallow-1-methyl)imidazolinium methylsulfate and the like;

(3) Diamido quaternary ammonium salts such as: methyl-bis(hydrogenated tallow amidoethyl)-2-hydroxyethyl ammonium methyl sulfate, methyl bis(tallowamidoethyl)-2-hydroxypropyl ammonium methylsulfate and the like;

(4) Biodegradable quaternary ammonium salts such as N,N-di(tallowoyl-oxy-ethyl)-N,N,-dimethyl ammonium methyl sulfate and N,N-di(tallowoyl-oxypropyl)-N,N-dimethyl ammonium methyl sulfate, biodegradable quaternary ammonium salts are described, for example, in U.S. Pat. Nos. 4,137,180, 4,767,547 and 4,789,491 incorporated by reference herein.

Preferred biodegradable quaternary ammonium salts include the biodegradable cationic diester compounds of the formula:

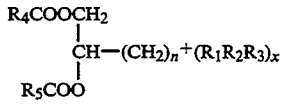

as described in U.S. Pat. No. 4,137,180, herein incorporated by reference.

(ii) Tertiary fatty amines having at least one and preferably two $C_8$ to $C_{30}$, preferably $C_{12}$ to $C_{22}$ alkyl chains. Examples include hardened tallow-dimethylamine and cyclic amines such as 1-(hydrogenated tallow)amidoethyl-2-(hydrogenated tallow)imidazolium. Cyclic amines which may be employed for the compositions herein are described in U.S. Pat. No. 4,806,255 incorporated by reference herein.

(iii) Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN 60 (ICI) which is a mixture of sorbitan and isosorbide stearates.

(iv) Fatty alcohols, ethoxylated fatty alcohols, alkylphenols, ethoxylated alkylphenols, ethoxylated fatty amines, ethoxylated monoglycerides and ethoxylated diglycerides.

(v) Mineral oils, and polyols such as polyethylene glycol.

(vi) Silicone oils

These softeners are more definitively described in U.S. Pat. No. 4,134,838 the disclosure of which is incorporated by reference herein. Preferred fabric softeners for use herein are acyclic quaternary ammonium salts, di(hydrogenated)tallowdimethyl ammonium methylsulfate is most preferred for dryer articles of this invention.

Electrolyte

It is preferable to prepare the fabric conditioning compositions of the invention with dissolved electrolyte. The term "electrolyte" means any ionic water soluble material. The electrolyte may be dissolved or suspended as particles of solid if the total electrolyte concentration of the liquid is higher than the solubility limit of the electrolyte. Mixtures of electrolytes also may be used. The preferred range of electrolyte is from 0.01 wt. % to 5%, more preferably from 0.1 to 2% and most preferably from 0.2% to 1%.

Optional Ingredients

Optional ingredients which may be included in the fabric conditioning compositions of the invention, in their conventional levels include optical brighteners or fluorescent agents, perfumes, colorants, germicides and bactericides. The general level of any such ingredient is up to 0.5% by weight.

Composition Processing

To manufacture the fabric conditioning compositions, the polymer and desired molten actives are selected (pre-addition stage). The molten active is generally dispersed into hot water in a temperature range of about 60° to 100° C. An effective amount of electrolyte is added to the aqueous mixture to disperse the molten active. Dispersion proceeds with a stirring at high speeds in a range of 300 rpm to 2,000 rpm for about 20 to about 30 minutes (post addition stage).

The polymers of the invention are added into the molten dispersion. Alternatively, the desired polymers may be added with the actives into the hot water in the initial step. It is preferable to add the polymers to the molten dispersion.

The polymers and fatty amine salt complexes may either be performed prior to addition into the formulation or may be formed in situ in the fabric conditioning active mixtures at either the pre-addition state or post-addition state. Electrolyte may additionally be added after the post addition of the polymers to further aid in dispersion. The dispersion is then homogenized and optional ingredients may be added.

The invention is illustrated by way of the following examples. Unless stated to the contrary, all percentages in the examples are by weight.

EXAMPLE 1

TABLE 1

| | | COMPOSITION OF POLYMERS | | | | | | |
|---|---|---|---|---|---|---|---|---|
| | | Hydrophilic Monomer | | Acidic | Acidic Chain Transfer Agent | | | |
| Sample | Polymer Type | Acrylamide | Hydroxylethyl Acrylate | Comonomer Acrylic Acid | Mercapto-succinic acid | Mercapto-acetic acid | Mercapto-propanol | % Solid |
| 1 | A | 91.34% | — | 4.8% | — | — | 3.86% | — |
| 2 | B | — | 100% | — | — | 1.5% | — | 40.4% |
| 3 | B | — | 97% | — | 3% | — | — | 39.5% |
| 4 | B | — | 94.3% | — | — | 5.7% | — | 43% |
| 5 | B | — | 97% | — | 3% | — | — | 40.7% |
| 6 | B | — | 94.3% | — | 5.7% | — | — | 40.4% |
| 7 | A | — | 91.3% | 5.8% | — | — | 2.9% | 36.5% |
| 8 | A | — | 77.7% | 19.4% | — | — | 2.9% | 35.1% |
| 9 | A | — | 68% | 29% | — | — | 3% | 37.6% |
| 10 | C | — | 94% | 3% | — | 3% | — | 40% |

Preparation of Polymers

Acrylamide/Acrylic Acid/Chain Transfer Agent

The polymer of Sample 1 was prepared by adding 40 g of deionized water to a 250 ml flask equipped with stirrer, condenser, temperature controller and nitrogen inlet and outlet. The reaction was purged with $N_2$ gas and heated to 95° C. 0.6 g of potassium persulfate was added to the reactor. Following this a monomer mixture containing 30 g of deionized water, 28.5 g of acrylamide and calculated amount of acrylic acid and chain transfer agent was fed to the reactor for 50 to 60 minutes. After adding all the monomers, the reaction was held at 95° C. for another 5 hours. The polymer solution was then cooled and used for formulations.

Hydroxyethylacrylate/Acrylic Acid/Chain Transfer Agent

Samples 2–10 were prepared by the following method. 100 g of deionized water was charged to a 500 ml flask equipped with $N_2$ inlet, stirrer, condenser and temperature controller. The reactor was purged with $N_2$ gas and heated to 95° C. The monomer mixture (100 g of hydroxyethylacrylate and calculated amount of acrylic acid) and a mixture of 50 g of water, 1.5 g of potassium persulfate, and calculated amount of chain transfer agent were fed simultaneously to the reactor for a period of 40 to 50 minutes. The reactor was held at 95° C. for another 5 hours. The polymer solution was then cooled to room temperature and used for formulation.

EXAMPLE 2

The 10 polymer samples of Example 1 were used to prepare the fabric conditioning samples described in Table 2 as follows. Each selected polymer was mixed with a dispersion of dihydrogenatedtallow dimethyl ammonium chloride (DHTDMAC) and Varamide T55. The dispersion was made by comelting the DHTDMAC and Varamide T55 at 160° F. The Molten actives were then mixed into a solution of water and citric acid at 130° F. with mixing at 250 rpm using an overhead stirrer and a stirrer blade. As the mixture began to gel, the mixing speed was increased to 600 rpm and NaCl was added in the form of a 10% solution. As the mixture thinned, the mixing speed was lowered to 350 rpm. The mixing speed was maintained for 15 minutes from the time the salt was added and the dispersion temperature was kept at 130° F. The mixture was then allowed to cool to 95° F. with mixing at 250 rpm. The polymer was added to the dispersion and mixing was continued for another 10 minutes at this temperature. Final concentrations of polymer, DHTDMAC, Varamide T55, citric acid and NaCl in the dispersion were 14.6%, 2.9%, 0.16%, respectively and the pH was about 3.0 for these formulations. These mixtures were then stored in a jar at room temperature, 35° F., and 125° F. for one week; their viscosities were measured with Brookfield-LV at 12 rpm and the results are shown in Table 2. The control with no polymers became very thick after one week at 35° F. and 125° F.

TABLE 2

| | Stability of Liquid Fabric Softeners with Polymers | | | | |
|---|---|---|---|---|---|
| | | | 1 Week | | |
| Fabric Conditioning Formulations | Polymer Sample | Viscosity | Room Temperature | 35° F. | 125° F. |
| 1 | none | 442 cps. | 627 | too thick | too thick |
| 2 | 2 | 320 | 600 | 5,800 | 4,500 |
| 3 | 3 | 290 | 480 | too thick | 5,850 |
| 4 | 4 | 400 | 920 | too thick | 8,800 |
| 5 | 5 | 470 | 540 | too thick | 4,400 |
| 6 | 6 | 400 | 550 | too thick | 8,700 |
| 7 | 7 | 280 | 860 | too thick | 1,280 |
| 8 | 8 | 6,000 | 460 | too thick | 2,370 |
| 9 | 9 | very thick | too thick | too thick | too thick |
| 10 | 10 | 460 | 1,220 | too thick | 7,650 |

Formulations 2–8 and 10 exhibited good stability at room temperature and at elevated temperature. Formulation 9 gelled and was unstable. It was observed that the acid content of the polymers in formulation 9 was too high to produce stable compositions.

We claim:

1. A fabric conditioning composition comprising:

(a) from about 10 to about 70% of a hydrocarbon based fabric conditioning component selected from the group consisting of a cationic quaternary ammonium salt, a tertiary fatty amine having at least 1 $C_8$–$C_{30}$ alkyl chain, an ester of a polyhydric alcohol, a fatty alcohol, an ethoxylated fatty alcohol, an alkyl phenol, an ethoxylated alkyl phenol, an ethoxylated fatty amine, an ethoxylated monoglyceride, an ethoxylated diglyceride, a mineral oil, a polyol and mixtures thereof;

(b) from about 0.01% to 5 wt. % of an electrolyte; and (c) from about 0.01% to 5 wt. % of a water soluble polymer having a solubility greater than 1 gram per liter and an average molecular weight of from about 500 to 500,000 wherein said polymer comprises an association of a hydrophilic backbone with acidic groups and the hydrophilic backbone comprising monomer units selected from (i) one or more ethylenically unsaturated amides, (ii) one or more polysaccharides;

(iii) an ester of an ethylenically unsaturated acrylic and methacrylic acid;

(iv) a vinyl heteroacrylic amide;

(v) a vinyl alcohol obtained by a hydrolysis of a vinyl acetate;

(vi) an ethylene oxide; and (vii) an ethylene imine, the acidic groups being present in a range from about 0.1% to 30% by repeat unit of the polymer and the acidic groups being introduced to the hydrophilic backbone from an acidic chain transfer agent selected from the group consisting of mercaptosuccinic acid, mercaptoacetic acid and mercaptopropanol.

2. A fabric conditioning composition according to claim 1, wherein the hydrophilic monomer unit is selected from the group consisting of acrylamide, methacrylamide, hydroxyethylacrylate, hydroxypropylacrylate, N,N-dimethylacrylamide, polyethyleneglycol acrylate and mixtures thereof.

3. A fabric conditioning composition according to claim 1 wherein the water soluble polymer comprises compounds of formula IV selected from the group of compounds consisting of compounds of formula:

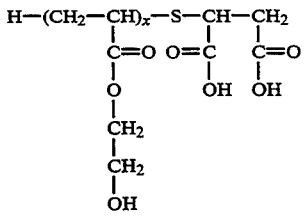

(V)

wherein x is 5 to 400, compounds of formula:

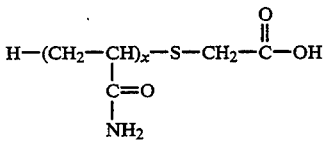

(VI)

wherein x is 5 to 400, and mixtures thereof.

4. A fabric conditioning composition according to claim 1 wherein the water soluble polymer compound is a compound of formula:

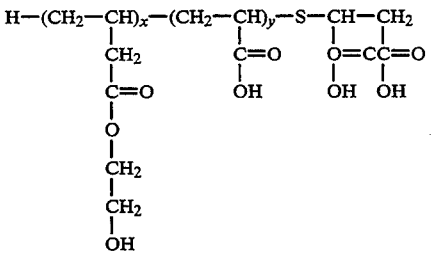

(VIII)

wherein x is 7 and y is 3.

5. A fabric conditioning composition according to claim 1 wherein the water soluble polymer is present in an amount of 0.1 to 3%.

6. A fabric conditioning composition according to claim 1 wherein the water soluble polymer comprises compounds selected from the group of compounds of formula II:

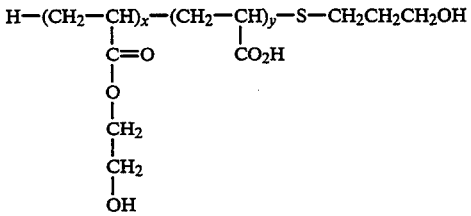

(II)

wherein x is 7 and y is 3, or compounds of formula III

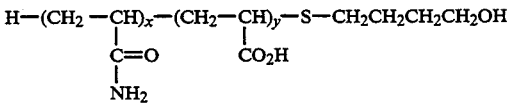

(III)

wherein x is 15 and y is 3, and mixtures thereof.

* * * * *